US005431375A

United States Patent [19]

Mitais et al.

[11] Patent Number: 5,431,375

[45] Date of Patent: Jul. 11, 1995

[54] COOLED CYLINDERS FOR HANDLING STEEL PRODUCTS

[75] Inventors: Jean-Christophe Mitais, Paris; Philippe Buchet, Combs la Ville, both of France

[73] Assignee: Stein Heurtey, Ris Orangis, France

[21] Appl. No.: 271,666

[22] Filed: Jul. 7, 1994

[30] Foreign Application Priority Data

Jul. 9, 1993 [FR] France ..... 93 08508

[51] Int. Cl.[6] ..... F27D 5/00

[52] U.S. Cl. ..... 266/274; 266/278

[58] Field of Search ..... 266/274, 278

[56] References Cited

U.S. PATENT DOCUMENTS 5,143,684 9/1992 Stein ..... 266/274
5,238,230 8/1993 Cochran ..... 266/274

FOREIGN PATENT DOCUMENTS 0345147 12/1989 European Pat. Off. .
2391442 12/1978 France .
2498164 7/1982 France .
2713741 10/1978 Germany .
3740620 6/1988 Germany .

*Primary Examiner*—Peter D. Rosenberg
*Attorney, Agent, or Firm*—Pollock, Vande Sande & Priddy

[57] ABSTRACT

Cooled rollers for handling and conveying metallurgical and ferro-metallurgical products, moving inside a furnace, each of these rollers being formed by a water-cooled central shaft on which discs are mounted perpendicularly to the said central shaft in order to serve as a support for the ferro-metallurgical products, wherein the said central shaft are provided with thermal insulation shields for avoiding radiative heat transfer between the atmosphere in the furnace and the cooled shaft of the said roller.

7 Claims, 1 Drawing Sheet

COOLED CYLINDERS FOR HANDLING STEEL PRODUCTS

Figure 1:
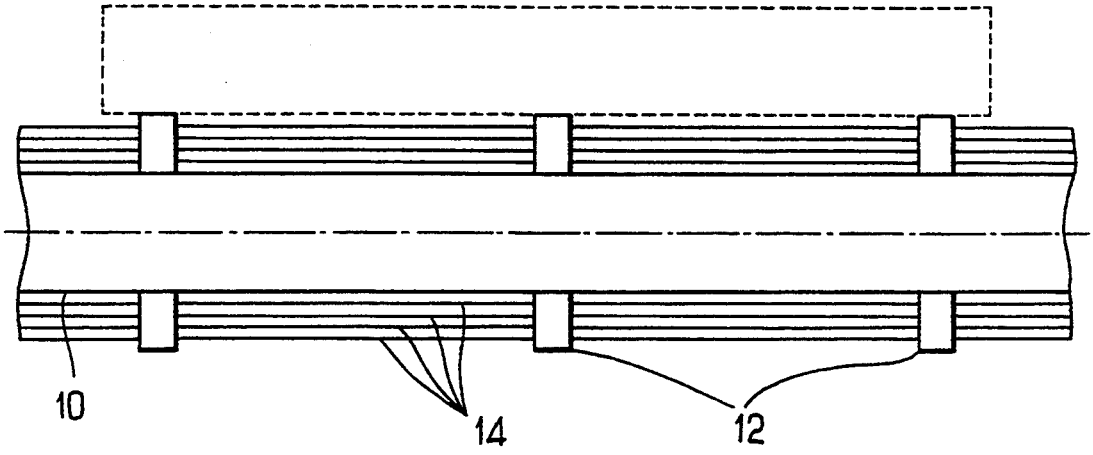

The present invention relates to improvements made to the rollers which are used especially in heat-treatment furnaces for handling the product, in particular metallurgical and ferro-metallurgical products, moving inside such furnaces.

It is known that, during the movement of a product, especially a metallurgical and ferro-metallurgical product inside a furnace, this product has to be brought to a specific temperature level, this requiring the means for handling and conveying the product in the furnace to be designed and made as a function of the thermal environment conditions defined for the product (generally, high temperature) and also as a function of the characteristics of the product (especially, weight, nature, etc.).

Furthermore, it is necessary that the means making it possible to move the product, for example a metallurgical or ferro-metallurgical product, inside the furnace be made so as to make it possible to move this product at different speeds, low or high speeds, in order to take industrial requirements into account.

Finally, the lifetime of the handling and conveying means in the furnace must be sufficiently long compared with other mechanical systems employed in the furnace, that is to say the handling means must be able to maintain their initial performance level over time.

In order to solve the problems thus raised and mentioned hereinabove, the current art has developed two solutions which are either suitable for heavy products, but which do not allow movement of the products at high speeds (this type of solution is that of longitudinal running members), or free of any limit as regards the speed of movement of the products, but which are poorly suited for the case of heavy products (they involve installations of the roller type).

In this latter solution, the handling and conveying rollers must be designed and made so as to guide the products correctly right along the furnace and so that the thermal marking of the products by the rollers is as slight as possible.

Among installations of the roller type, the art of conventional rollers made from centrifuged refractory steel is known. These rollers have the drawback of being at the limit of what is possible for temperatures greater than or equal to 1,100° C.; this type of roller comprises a water-cooled central tube requiring a high installed heating power, as regards the furnace, this being so as to compensate for the heat losses resulting from the cooling of the tubes of the rollers.

Among installations of this type, handling and conveying systems having ceramic rollers are also known. Such a system has the drawback of being sensitive to mechanical impact.

Finally, another known system consists of providing a double-jacket roller. However, this system is too complicated to produce.

The present applicant has recently developed a system of cooled rollers which is described, especially, in FR-A-2,632,286.

This system consists of making the handling rollers from a central shaft which is cooled, for example, by water, on which discs separated by an insulating refractory are mounted, these discs arranged perpendicularly to the longitudinal axis of the roller serving as a support for the products to be handled and conveyed.

In such a system, the insulation of the rollers thus made poses two problems:

- a low mechanical resistance to impacts or catching on the products, leading to numerous incidents, given that the shape of the products is less flat than one would imagine;
- on account of the required operating temperatures, the usual insulations which are mounted on a moving article rapidly break up at the temperatures of use because of the accelerations and decelerations during the movement of the products.

Under these conditions, the lifetime of this insulation of the rollers does not exceed six months, which means the operator, to his disadvantage, has to provide very frequent, tedious and expensive maintenance.

In fact, in this type of insulation of the rollers, it is the poor thermal conductivity of the insulation which minimizes the flux exchanged between the environment of the furnace and the cooled shaft of the roller.

The invention is proposed to provide a novel type of cooled roller which does not have the drawbacks, mentioned hereinabove, of the handling systems having rollers according to the prior art.

Consequently, the invention relates to cooled rollers for handling and conveying products, and, in particular, metallurgical and ferro-metallurgical products, moving inside a furnace. Each of these rollers are formed by a water-cooled central shaft on which discs are mounted perpendicularly to the said central shaft in order to serve as a support for the products, characterized in that arranged around the central shaft are one or more shields providing thermal insulation, opposing radiative heat transfer between the atmosphere in the furnace and the cooled shaft of the roller.

According to one characteristic of the invention, the shields providing the thermal insulation may be of cylindrical, conical or frustoconical shape, or of any other shape which makes it possible to prevent radiative heat transfer.

According to one characteristic of the invention, the heat shields are made sufficiently thin and conducting for them to be regarded as isothermal, thus providing purely radiative insulation.

According to another characteristic of the invention, the heat shields are made so as to provide both radiative and conductive insulation, the nature and thickness of the said shields then being determined so as to make it possible to establish a significant temperature gradient within them.

Other characteristics and advantages of the present invention will emerge from the description given hereinbelow with reference to the appended drawings which illustrate an illustrative embodiment thereof, this embodiment being free of any limiting character.

Figure 2:
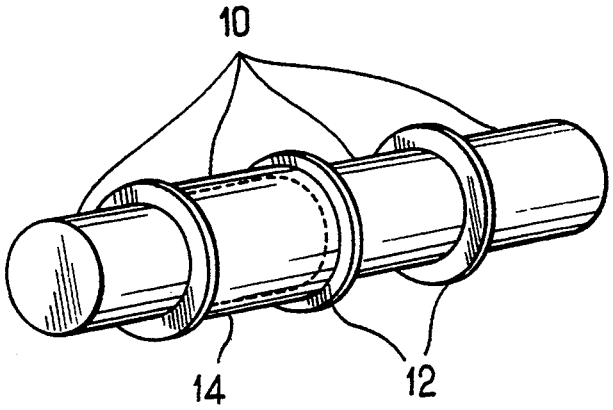

In the drawings:

FIG. 1 is an axial sectional diagrammatic view of an improved cooled roller according to the present invention, and FIG. 2 is a perspective diagrammatic view showing the roller of FIG. 1.

Referring to the drawings, it may be seen that each roller of the system for handling and conveying the products, for example, metallurgical and ferro-metallurgical products, inside the furnace, includes a central tubular shaft 10 which is cooled, for example by water. Discs 12, arranged perpendicularly to the central shaft, are distributed at predetermined intervals on the shaft.

These discs serve as a support for the ferro-metallurgical products.

According to the present invention, the flux exchanged between the environment in the furnace and the cooled shaft 10 of the roller is minimized by one or more shields which, in this non-limiting illustrative embodiment, are made in the shape of cylindrical heat shields 14 arranged around the cooled shaft 10.

As has already been mentioned, these heat shields 14 may have any other appropriate shape such as, for example, one which is conical, frustoconical, etc.

According to the invention, the said shields may be made of a metal or alloy or of any other sufficiently impact-resistant material.

Excellent insulation of the rollers is thus obtained.

According to the invention, it is possible to obtain:

either a purely radiative insulation, by making the shields 14 sufficiently thin and conducting for them to be regarded as isothermal;

or an insulation which is both radiative, obtained in the manner specified hereinabove, and conductive, the nature and thickness of the shields 14 then being specified so as to establish a significant temperature gradient within them. In this case, the shields may be formed by several layers of different materials: metals, alloys, composite materials, honeycomb structures, etc.

The cooled rollers thus improved according to the invention make it possible to obtain insulations which have a good mechanical resistance to impacts on the products handled, combined with a behavior over time which is considerably enhanced compared with the rollers according to the prior art. The reliability of the handling systems which include such rollers is thus increased, thereby making it possible to reduce their maintenance to a minimum.

Of course, it remains the case that the present invention is not limited to the illustrative embodiments described and/or shown here but encompasses all the variants thereof.

We claim:

1. Cooled rollers for handling and conveying metallurgical and ferro-metallurgical products, moving within a furnace, each of the rollers comprising:

a water-cooled central shaft;

a plurality of axially displaced disks perpendicularly mounted to the exterior of the shaft for supporting the products;

a plurality of thin heat shields mounted in contacting relation to an outside surface of the central shaft, at least one of the heat shields being conductive;

the shields insulating the water-cooled shaft from radiation heat transfer from the furnace atmosphere.

2. Cooled rollers according to claim 1, wherein the shields are selected from the group consisting of cylindrical, conical, or frustoconical shapes.

3. Cooled rollers according to claim 1, wherein the heat shields provide both radiation and conduction insulation, the material and thickness of the shields being varied so as to establish a significant temperature gradient between them.

4. Cooled rollers according to claim 1, wherein the heat shields are made of metallic materials.

5. Cooled rollers according to claim 1, wherein the heat shields are made of composite materials.

6. Cooled rollers according to claim 1, wherein the heat shields are made of honeycomb structures.

7. Cooled rollers according to claim 1, wherein the shields are formed by several layers of different materials selected from the group consisting of metals, alloys, composite materials or honeycomb structures.

* * * * *